United States Patent [19]

Blake

[11] 4,158,446

[45] Jun. 19, 1979

[54] SELF-LOCKING CORE CHUCKS

[76] Inventor: Arthur T. Blake, #1 Hilltop Cir., Whippany, N.J. 07981

[21] Appl. No.: 896,999

[22] Filed: Apr. 17, 1978

[51] Int. Cl.[2] ..... B65H 75/24

[52] U.S. Cl. ..... 242/68.2; 242/72 R

[58] Field of Search ..... 242/72 R, 72 B, 68.2, 242/72.1, 68.1, 68.4; 279/2 R

[56] References Cited

U.S. PATENT DOCUMENTS

| | | | |
|---|---|---|---|
| 2,798,678 | 7/1957 | Dadd | 242/72 R |
| 3,231,212 | 1/1966 | Blake | 242/72 R X |
| 3,281,092 | 10/1966 | Schultz et al. | 242/72 R |
| 3,387,799 | 6/1968 | Wilson | 242/72 R |
| 3,870,243 | 3/1975 | Briggs | 242/72.1 |
| 3,993,317 | 11/1976 | Flagg | 242/68.2 X |
| 3,999,720 | 12/1976 | Eberlin | 242/72 R X |

*Primary Examiner*—Harvey C. Hornsby
*Assistant Examiner*—John M. Jillions
*Attorney, Agent, or Firm*—Ernest G. Montague

[57] ABSTRACT

A core chuck designed to lock the core of a roll of material winding and unwinding operations to a mandrel, which core chuck comprises a core and a tubiform cylindrical chuck body dimensioned to accommodate the core. Means are provided for fastening the chuck body onto the mandrel shaft. The chuck body defines on the surface opposite the core at least one recess disposed parallel to the rotating axis thereof which recess has a releasably terraced bottom step plate including at least one step ascending from a common center groove to each side of the recess. The top faces of the step and of the common center groove are substantially parallel to and spaced apart at different distances from the opposite smooth face of the core. At least one toothed roller is disposed in the recess with its axis parallel to the axis of the chuck body. The top face of each of the steps has two raised ribs spaced apart from each other to define an axially disposed groove therebetween, and receives the corresponding tooth of the toothed roller, in order to prevent an axial movement and an inclined position of the latter. Retaining means are provided to prevent the overextension of the springs, as well as the outward movement of the locking roller and of the step plate. The retaining means may include an arch shaped stamping which is inserted with slight pressure at each end of the roller recess, to form a cover or roof, both legs of the arch shaped stamping resting on the top side of the step plate. The toothed roller has an extended pin on each end and said extended pin is disposed spaced apart from the bottom face of said stamping upon locking the same in said core.

2 Claims, 11 Drawing Figures

SELF-LOCKING CORE CHUCKS

The present invention relates to self-locking and self-adjusting core chucks for winding and unwinding rolls of various materials, such as webs, films or foils, which, while being processed or used, are wound into or unwound from rolls having a hollow, cylindrical core, usually made of cardboard. In handling of such materials, a spindle or shaft is passed through the core and so-called core chucks are employed to lock the core to the spindle or shaft.

In the applicant's own prior U.S. Pat. No. 3,022,959, dated Feb. 27, 1962, a core chuck, designed to lock the core of a roll of material during winding and unwinding operations to a mandrel, is disclosed, which comprises a tubiform cylindrical chuck body dimensioned to accommodate a core and which also includes means for fastening the chuck body onto a mandrel shaft, the chuck body defining on the surface opposite the core a recess disposed parallel to the rotating axis thereof. The recess has a terraced bottom including at least one step ascending from a common center groove to each side of the recess. The faces of the step and of the common center groove are substantially parallel to and spaced apart at different distances from the opposite smooth face of the core. A toothed roller is arranged in the recess with its axis parallel to the axis of the chuck body. The roller has an overall diameter slightly in excess of the greatest depth of the recess with one tooth resting on the bottom of the common center groove and an opposing tooth adapted to bite in the opposite face of the core to form a pivot point for turning of the roller. A tooth adjacent to the one tooth being adapted to mount the step adjacent the common center groove in response to a lateral force acting upon at least the opposing tooth of the roller and finally spring means are arranged for returning the roller into the lowermost position in the recess upon cessation of the lateral force.

It has been found, however, that under certain conditions, the toothed roller assumes positions, which are not exactly parallel to the chuck axis as it rises from one step to the next, which interferes with the proper operation of the self-locking core chuck, and in addition, it has also been found that under these circumstances the toothed roller slips axially even under the severe stresses involved in locking the core.

In applicant's own further prior U.S Pat. No. 3,231,212, dated Jan. 25, 1966, a self-locking core chuck is disclosed, which includes means for keeping the toothed roller constantly parallel to the chuck axis as it rises and means for preventing an axial slippage of the toothed roller even under the severe stresses involved in locking the core, and also wherein the chuck body has a recess disposed parallel to the rotating axis thereof and a terraced bottom formed in the recess by a separate member releasably and exchangeably secured to the chuck body. Referring again to the applicant's own prior U.S. Pat. No. 3,231,212, the retainer rings of said prior patent were actually washers of different diameters and thickness secured to both ends of the chuck body. The mentioned retainer rings were designed to prevent lateral movement of the toothed rollers.

It has been found also, however, that under certain conditions retaining means have to be provided for the locking means, namely for the roller, the spring, and the like. The retaining means operate as a safety feature in the event of inexperienced or careless misuse. Such misuse can be brought about, when a chuck is subjected to high rotational speeds with the absence of a cardboard core.

It is, therefore, one object of the present invention to provide retaining means for the locking means, to prevent the overextension of the springs and the outward movement of the locking roller and of the step plate.

It is another object of the present invention to provide an arch shaped stamping, preferably of steel, inserted with slight pressure at each end of the roller recess to form a cover or roof, with both legs of the arch shaped stamping resting on the topside of the step plate as a means for retaining it. The stampings themselves are enclosed by steel bands or round wire rings for retention thereof.

With these and other objects in view, which will become apparent in the following detailed description, the present invention will be clearly understood in connection with the accompanying drawings, in which.

Figure 1:
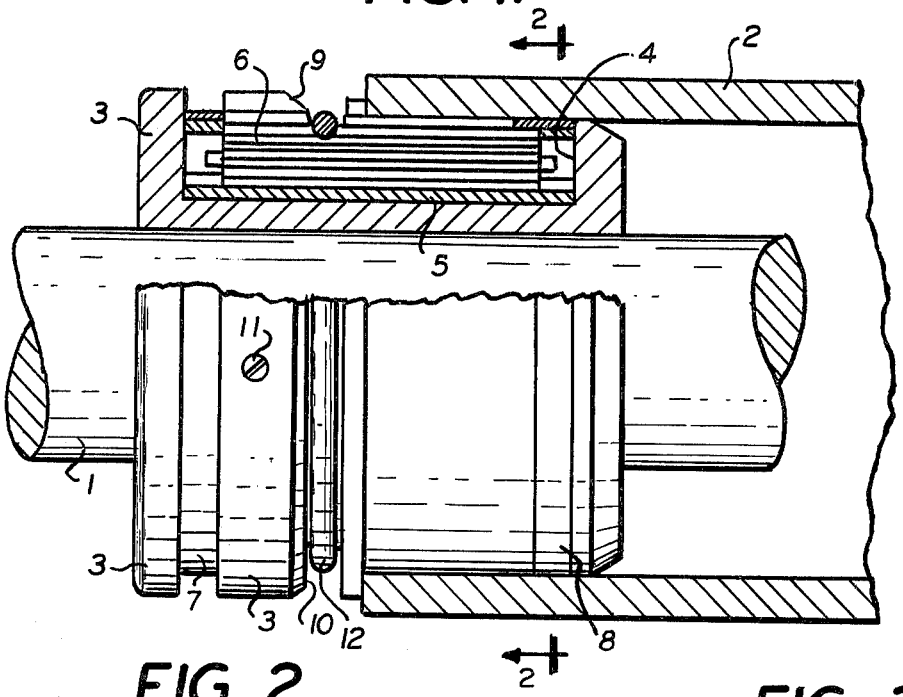
FIG. 1 is a partly sectional side view of a self-locking shoulder type core chuck.

Referring now to the drawings, and in particular to FIGS. 1-7, the self-locking core chuck 3 comprises a mandrel shaft 1 inserted into a core 2, which may be, for example, one of the cardboard cores used for the winding and unwinding of rolls of various materials. Two such core chucks 3 of predetermined size are fastened to the mandrel shaft 1 and, in particular, one at each end of the core 2. The core chucks 3 are formed of hollow cylindrical bodies, which can be machined down at least at one end to short, truncated cones, in order to facilitate insertion of the chucks into the core 2 up to a rear shoulder of somewhat larger diameter, though such shoulder can be omitted, in order to permit a sliding through of the core chucks.

Figure 2:
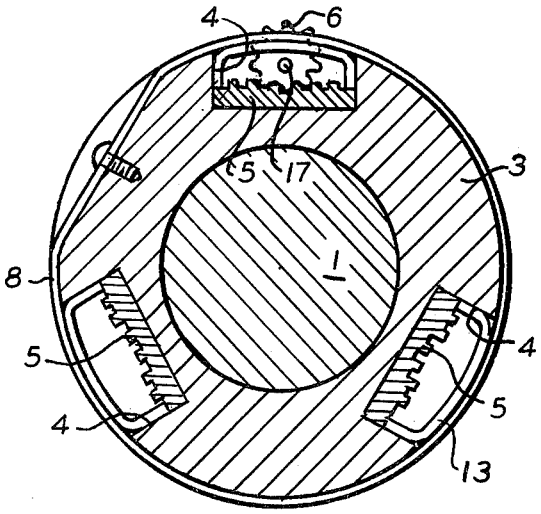
FIG. 2 is a sectional view along the lines 2—2 of FIG. 1.

As shown in FIG. 2 of the drawings, one or more, but preferably three peripheral and co-axial recesses 4 are cut longitudinally into the chuck body 3, though three such recesses 4 are shown in FIG. 2, whereby the bottom of each of the recesses 4 is terraced in form of opposite stairs descending toward a common bottom groove, to provide a step plate 5 at the bottom of the recesses 4.

Inserted into each of the recesses 4 is a toothed roller 6, which, preferably, is of the same length as the recess 4, to fit closely, but freely rotatable, between a front retainer ring 7 and a rear retainer ring 8. The toothed roller 6 is provided with a neck journal 9 which is lined up with a groove 10 cut into the surface of the chuck body 3 perpendicularly to its axis. A set screw 11 extending radially through the hollow cylindrical body locks the core chuck 3 to the mandrel shaft 1.

The diameter of the toothed roller 6 is selected to slightly exceed the greatest depth of the peripheral recess 4. Accordingly, when the toothed roller 6, held by a helical spring 12, is at rest, as shown in full lines in FIG. 3 of the drawings with one of the teeth positioned within the center groove of the recess 4, the uppermost tooth of the toothed roller 6 projects just about beyond the periphery of the chuck body 3 and only a relatively light effort is needed to insert the chuck within the core 2. Most of the light effort is expended to produce an intimate contact between the rim of this tooth and the inner surface of the core 2. Thus the uppermost tooth of the toothed roller 6 should penetrate slightly into the inner face of the cardboard core 2 upon insertion of the chuck or make at least sufficient contact with the cardboard core 2 to be forced along by any rotational movement of the cardboard core 2 with respect to the mandrel shaft 1 and the core chuck 3.

If this is the case, the toothed roller 6, which, while being held by the helical spring 12 and until now rested with its lowermost tooth against the bottom groove of the step plate 5, is forced into ascending the stairs in the direction of the rotary movement of the cardboard core 2, or it is forced to mount the stairs in the opposite direction of the rotary movement of the mandrel shaft 1, depending whether the rotational movement originates with the cardboard core 2 or with the mandrel shaft 1. As a result, the uppermost tooth of the toothed roller 6 penetrates into the cardboard core 2 to the extent of its ascent upon the stairs and a substantially unbreakable contact between the cardboard core 2 and the mandrel shaft 1 is produced permitting winding and unwinding operations, respectively, at a high speed and in the presence of a heavy rotary pull on the part of the mandrel shaft 1 or of a lateral pull of the same exerted upon the web.

It is quite apparent that this intimate contact between the cardboard core 2 and the mandrel shaft 1 can be broken the moment the winding or unwinding operation comes to a rest. A slight rotational movement of either the core 2 or of the mandrel shaft 1 in the opposite direction to that of the direction of rotation, causes the toothed roller 6 to descend into its rest position within the bottom groove. This movement is aided by one or more springs which up to this moment had been under increased tension.

An arch shaped stamping 13, preferably made of steel, is inserted with slight pressure at each end of the recess 4, to form a cover or roof, with both legs 14 of the arch shaped stamping 13 resting on the top face of the step plate 5, to operate as retaining means. In addition the stampings 13 are enclosed by steel bands 7 and 8, wire rings 15, or the like, to keep the stampings 13 in permanent engagement with the step plate 5, at the same time maintaining the step plate 5 in its position in the recess 4. Thus a safety feature is provided in the event of the inexperienced or careless misuse of the chuck, which misuse is brought about when a chuck is subjected to high rotational speeds with the absence of a cardboard core 2. Under such conditions the springs 12 will be overextended and the toothed roller 6 and the step plate 5 will tend to move outwardly due to the effect of the created centrifugal force. This outward movement will be retained by the arch shaped stamping 13 reinforced by the bands 7 and 8 or rings 15.

The arch shaped stamping 13 has two notches 16 in its top surface which are used to facilitate removal or replacement of the toothed rollers 6. The toothed roller 6 has, in conventional manner, an extended pin on each end.

Figure 3:
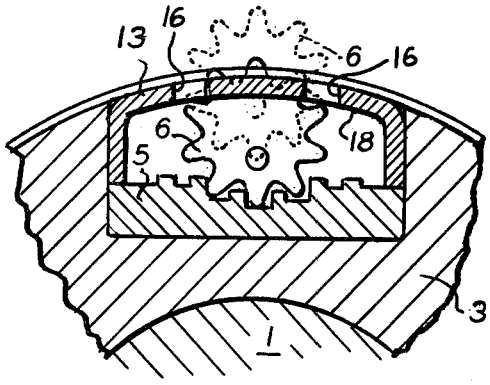
FIGS. 3 and 4 are enlarged sectional views along the lines 2—2 of FIG. 1, disclosing the locking roller in two different operational positions.
Figure 5:
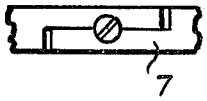
FIG. 5 is an end view of the joining ends of the retention band.
Figure 4:
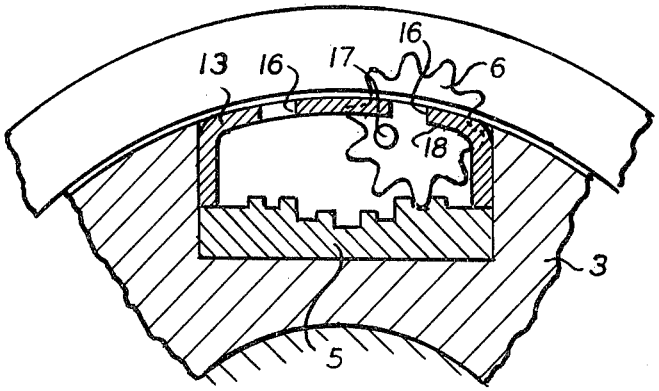
Figure 6:
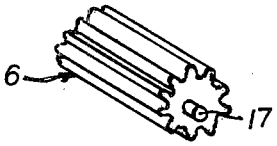
FIG. 6 is a perspective view of the locking roller.
Figure 7:
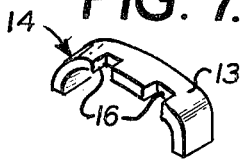
FIG. 7 is a perspective view of the arch shaped stamping.

FIG. 3 shows the toothed roller 6 at rest, as indicated in full lines, and at its maximum outward position, as indicated in dotted lines in FIG. 3, which position is brought about by the mentioned centrifugal force. As shown in FIG. 4 of the drawings, the projected pin 17 of the toothed roller 6 does not touch the bottom face 18 of the stamping 13 upon completely locking it in the cardboard core 2. The pin 17 serves the purpose to locate the rotary axis of the toothed roller 6.

Figure 8:
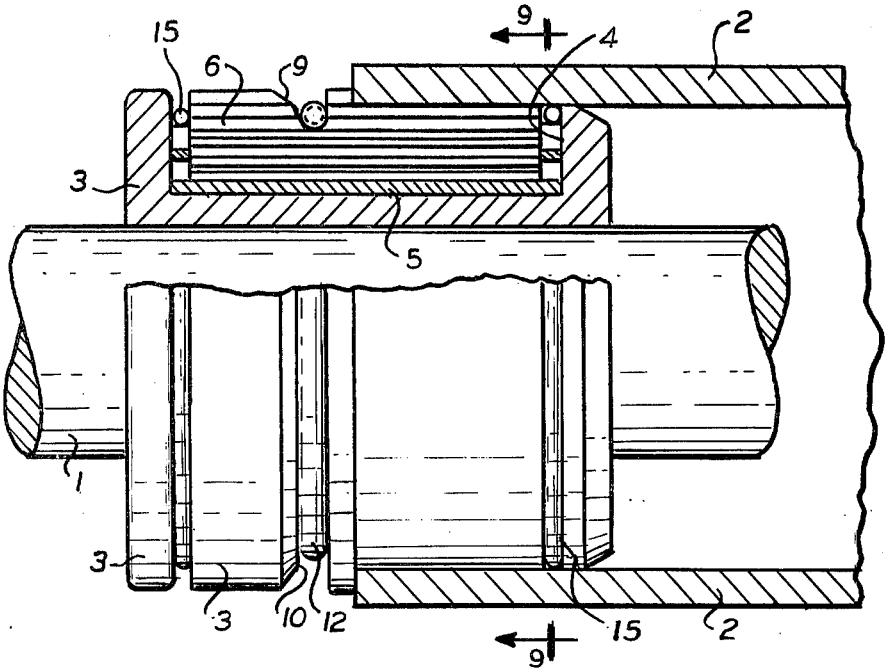
FIG. 8 is a partly sectional side view of the self-locking core chuck similar to that shown in FIG. 1, yet having a round wire retention ring instead of the retention band.
Figure 9:
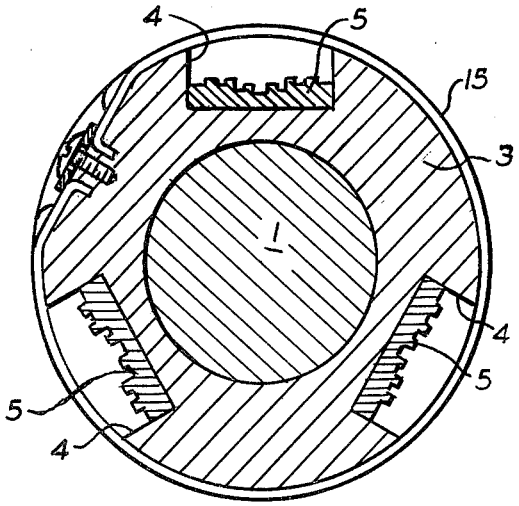
FIG. 9 is a sectional view along the lines 9—9 of FIG. 8.
Figure 10:
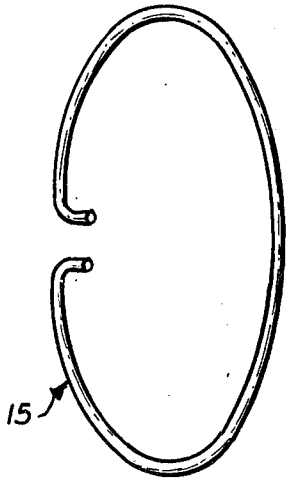
FIG. 10 is a perspective view of the round wire retention rings.
Figure 11:
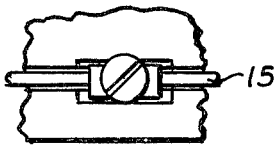
FIG. 11 is an end view of the joining ends of the round wire retention ring.

As indicated above FIGS. 8–11 demonstrate a second embodiment of the present invention and accordingly FIG. 8 is identical with the structure of FIG. 1 with the exception that FIG. 1 shows the use of steel bands 7 and 8, while in FIGS. 8 and 10 the wire ring 15 is shown in use instead. It is to be understood that the base plate can be used with the arch shaped stamping 13 or without it, though it is preferable to use the stamping also in connection with the showing of FIG. 9 of the drawings.

While I have disclosed several embodiments of the present invention, it is to be understood that these embodiments are given by example only and not in a limiting sense, the scope of the present invention being determined by the objects and the claims.

I claim:

1. A core chuck designed to lock the core of a roll of material winding and unwinding operations to a mandrel, said core chuck comprising a core, a tubiform cylindrical chuck body dimensioned to accommodate said core, means for fastening said chuck body onto a mandrel shaft, said chuck body defining on the surface opposite said core at least one recess disposed parallel to the rotating axis thereof, said recess having a terraced bottom step plate including at least one step ascending from a common center groove to each side of said recess, the top faces of said step and of said common center groove being substantially parallel to and spaced apart at different distances from the opposite smooth face of said core, at least one toothed roller disposed in said recess with its axis parallel to the axis of said chuck body, the top face of each of said steps having two raised ribs spaced apart from each other to define an axially disposed groove therebetween, and receiving the corresponding tooth of said toothed roller, in order to prevent an axial movement and an inclined position of the latter, said toothed roller having an outer diameter slightly in excess of the greatest depth of said recess with one tooth resting on the bottom of said center groove and an opposing tooth adapted to bite into the opposite face of said core to form a pivot point for a turning of said roller, a tooth adjacent to said one tooth adapted to mount said step adjacent said common center groove and to enter said grooves between said raised ribs in response to a lateral force acting upon at least said opposing tooth of said toothed roller, resilient means engaging said toothed roller to return said roller into the lowermost position in said recess upon cessation of said lateral force, retaining means to prevent the over-extension of said resilient means and the outward movement of said toothed roller and of said plate, and said retaining means including a substantially arch shaped stamping resting on the top face of said step plate and being enclosed by steel bands.

2. A core chuck designed to lock the core of a roll of material winding and unwinding operations to a mandrel, said core chuck comprising a core, a tubiform cylindrical chuck body dimensioned to accommodate said core, means for fastening said chuck body onto a mandrel shaft, said chuck body defining on the surface opposite said core at least one recess disposed parallel to the rotating axis thereof, said recess having a terraced bottom step plate including at least one step ascending from a common center groove to each side of said recess, the top faces of said step and of said common center groove being substantially parallel to and spaced apart at different distances from the opposite smooth face of said core, at least one toothed roller disposed in said recess with its axis parallel to the axis of said chuck body, the top face of each of said steps having two raised ribs spaced apart from each other to define an axially disposed groove therebetween, and receiving the corresponding tooth of said toothed roller, in order to prevent an axial movement and an inclined position of the latter, said toothed roller having an outer diameter slightly in excess of the greatest depth of said recess with one tooth resting on the bottom of said center groove and an opposing tooth adapted to bite into the opposite face of said core to form a pivot point for a turning of said roller, a tooth adjacent to said one tooth adapted to mount said step adjacent said common center groove and to enter said grooves between said raised ribs in response to a lateral force acting upon at least said opposing tooth of said toothed roller, resilient means engaging said toothed roller to return said roller into the lowermost position in said recess upon cessation of said lateral force, retaining means to prevent the over-extension of said resilient means and the outward movement of said toothed roller and of said plate, and said retaining means including a substantially arch shaped stamping resting on the top face of said step plate and being enclosed by wire rings, and said toothed roller having an extended pin on each end and said extended pin being disposed spaced apart from the bottom face of said stamping upon locking the same in said core.

* * * * *